US005310369A

United States Patent [19]

Kobayashi

[11] Patent Number: 5,310,369

[45] Date of Patent: May 10, 1994

[54] WATER JET PROPULSION UNIT

[75] Inventor: Noboru Kobayashi, Iwata, Japan

[73] Assignee: Yamaha Hatsudoki Kabushiki Kaisha, Iwata, Japan

[21] Appl. No.: 61,859

[22] Filed: May 14, 1993

Related U.S. Application Data

[60] Division of Ser. No. 735,154, Jul. 22, 1991, Pat. No. 5,254,023, which is a continuation of Ser. No. 489,361, Mar. 6, 1990, abandoned.

[30] Foreign Application Priority Data

| | | | |
|---|---|---|---|
| Mar. 8, 1989 | [JP] | Japan | 1-57589 |
| Mar. 8, 1989 | [JP] | Japan | 1-57590 |
| Mar. 10, 1989 | [JP] | Japan | 1-58985 |
| Mar. 16, 1989 | [JP] | Japan | 1-65274 |
| Apr. 21, 1989 | [JP] | Japan | 1-103253 |

[51] Int. Cl.[5] ..... B63H 11/00

[52] U.S. Cl. ..... 440/38; 440/53

[58] Field of Search ..... 440/38–42, 440/270, 53, 66–70, 61, 56, 76, 77; 114/270, 280, 363; 60/221, 222

[56] References Cited

U.S. PATENT DOCUMENTS

| | | | |
|---|---|---|---|
| 2,961,988 | 11/1960 | Wood | 440/53 |
| 3,207,116 | 9/1965 | France | 440/38 |
| 3,270,699 | 9/1966 | Bush | 114/280 |
| 3,422,788 | 1/1969 | Horan, Jr. | 440/40 |
| 3,478,712 | 11/1969 | Fox | 440/40 |
| 3,949,700 | 4/1976 | Baroody | 440/40 |
| 3,976,026 | 8/1976 | Eastling | 440/40 |
| 4,492,176 | 1/1985 | Arima | 114/56 |
| 4,568,291 | 2/1986 | Nelson | 114/246 |

FOREIGN PATENT DOCUMENTS

| | | |
|---|---|---|
| 2732671 | 2/1979 | Fed. Rep. of Germany . |
| 650118 | 1/1929 | France . |
| 1559977 | 3/1969 | France . |
| 2572052 | 10/1984 | France . |
| 996103 | 6/1965 | United Kingdom . |
| 80/0098 | 5/1981 | World Int. Prop. O. . |

*Primary Examiner*—Edwin L. Swinehart

*Attorney, Agent, or Firm*—Knobbe, Martens, Olson & Bear

[57] ABSTRACT

A number of embodiments of watercraft having jet propulsion units contained within a tunnel in the hull and wherein the jet propulsion unit is pivotal about a first transversely extending horizontal pivot axis for bringing the jet propulsion unit through trim adjusted positions to an upward out of the water position. In addition, the jet propulsion unit is rotatable about a horizontal longitudinally extending axis so that its downwardly facing water inlet portion may be rotated upwardly for access through an access opening in the hull for servicing. In one embodiment, the jet propulsion unit is only rotatable about the horizontal longitudinally extending axis. A number of embodiments of rudder assemblies are also depicted supported by the steering nozzle for generating steering effects when the steering nozzle is not generating a significant steering effect and which may be pivoted to an out of the water position for protection when underwater obstacles are struck.

9 Claims, 14 Drawing Sheets

WATER JET PROPULSION UNIT

This application is a Division of application Ser. No. 735,154 filed Jul. 22, 1991, now U.S. Pat. No. 5,254,023, which is a continuation of Ser. No. 489,361, filed Mar. 6, 1991, now abandoned.

BACKGROUND OF THE INVENTION

This invention relates to a water jet propulsion unit and more particularly to an improved watercraft construction and a propulsion unit therefor and to an improved arrangement for assisting the steering of a watercraft powered by a jet propulsion unit.

The advantages of jet propulsion units for watercraft are well known. Generally, these units permit the operation of the watercraft in shallower water than more conventional propeller driven craft In addition, the use of jet propulsion units has a number of other advantages in that they provide a neat configuration for the watercraft and storage of the watercraft both in the water and out of the water can be facilitated. However, as with conventional watercraft, there are some disadvantages that are existent with jet propelled watercraft.

For example, when the watercraft is left in the water for a long period of time and not utilized, encrustation of elements such as barnacles in the running components of the propulsion unit can be a problem In one form of jet propulsion unit, an outboard motor type of jet propulsion unit is employed that employs rather than a propeller a jet propulsion unit for achieving watercraft propulsion Of course, this type of propulsion unit can easily be tilted up out of the water as can the associated stern drive jet propulsion units in which the jet propulsion unit is mounted on the stern of a watercraft as with conventional propeller driven inboard/outboard drives. However, the use of such outboard motor type jet propulsion units has the disadvantages common with outboard motors That is, they provide an unsightly appearance for the watercraft, they raise the center of gravity and tend to concentrate a large portion of the weight at the hull of the watercraft and have other disadvantages.

Therefore, it is more desirable if the jet propulsion unit can be mounted in a tunnel formed at the rear of the watercraft hull. This provides not only a neat assembly, but also gives rise to improved construction of the watercraft as a whole by lowering its center of gravity and by moving heavy masses more forward in the hull. When the jet propulsion unit is positioned in or beneath the hull, many of the problems as aforenoted will be encountered. That is, the jet propulsion unit will clearly be underwater at all times even when not in use and encrustation can occur. Furthermore, because of its nature and the fact that the jet propulsion unit permits operating in shallow water, it may at times become clogged with foreign materials such as seaweed, sand or the like. When positioned in the tunnel of the watercraft hull, however, servicing is more difficult It is, therefore, a principal object of this invention to provide an improved watercraft and jet propulsion unit therefor.

It is a further object of this invention to provide a jet propulsion unit for a watercraft wherein the jet propulsion unit is positioned within the hull of the watercraft but nevertheless can be drained of water even when the watercraft is in the body of water but when it is not being operated.

It is a further object of this invention to provide an improved arrangement which permits the trim adjustment of a jet propulsion unit of this type.

It is yet a further object of this invention to provide a watercraft and hull arrangement having a jet propulsion unit that is positioned within a tunnel and wherein the jet propulsion unit can be conveniently serviced without necessitating removal from the hull or removal of the hull from the body of water in which the watercraft is operating.

It is known that the steering of a jet propelled watercraft is usually achieved by steering of the discharge nozzle of the jet propulsion unit. This means that the steering is somewhat related to the speed at which water is passing through the jet propulsion unit. Although this is generally acceptable, there are times when the steering by the jet propulsion unit alone may not be adequate. For example, when travelling at slow speeds or coasting, the jet propulsion unit itself may not provide adequate steering.

It has, therefore, been proposed to employ a separate rudder which can also be used for steering purposes when the jet propulsion unit steering is not fully effective. However, such rudders can become damaged, particularly when considering the type of shallow water in which jet propelled boats can be operated.

It is, therefore, a still further object of this invention to provide an improved steering rudder arrangement for a jet propulsion unit wherein the steering rudder will be protected from damage if underwater obstacles are encountered.

SUMMARY OF THE INVENTION

A first feature of this invention is adapted to be embodied in a watercraft having a hull which defines a tunnel at the rear end thereof. A jet propulsion unit is positioned substantially within the tunnel. The jet propulsion unit has a generally downwardly facing water inlet portion, an impeller portion containing an impeller for drawing water through the inlet portion and a discharge nozzle portion for discharge of water from the impeller portion for powering the watercraft An engine is supported within the hull and drive means drive the impeller from the engine. In accordance with this feature of the invention, means are provided for pivoting the jet propulsion unit about a generally horizontally extending axis that extends transversely to the longitudinal center line of the watercraft and which is positioned contiguous to the water inlet portion.

Another feature of the invention is adapted to be embodied in a jet propulsion unit for association with the hull of the watercraft for propelling the watercraft through a body of water. The jet propulsion unit has, as described in the previous paragraph, a water inlet portion, an impeller portion, and a discharge nozzle portion In accordance with this feature of the invention, means are provided for rotating the jet propulsion unit about a generally horizontally extending axis that extends longitudinally relative to the watercraft to rotate the water inlet portion from a downwardly facing position to an upwardly facing position.

A still further feature of the invention is also adapted to be embodied in a jet propulsion unit of the type in the two preceding paragraphs. In accordance with this feature of the invention, the jet propulsion unit discharge nozzle portion is supported for steering movement about a vertically extending steering axis for steering of the watercraft In addition, a rudder is pivotally supported by the discharge nozzle for generating a steering effect when travelling at least at low speeds or coasting. In accordance with this feature of the invention, the rudder is supported for pivotal movement relative to the nozzle and is held in a submerged position by a biasing spring. However, when an underwater object is struck, the biasing spring can yield and permit the rudder to swing upwardly to avoid damage to it and the jet propulsion unit.

DETAILED DESCRIPTION OF THE PREFERRED EMBODIMENTS OF THE INVENTION

Figure 1:
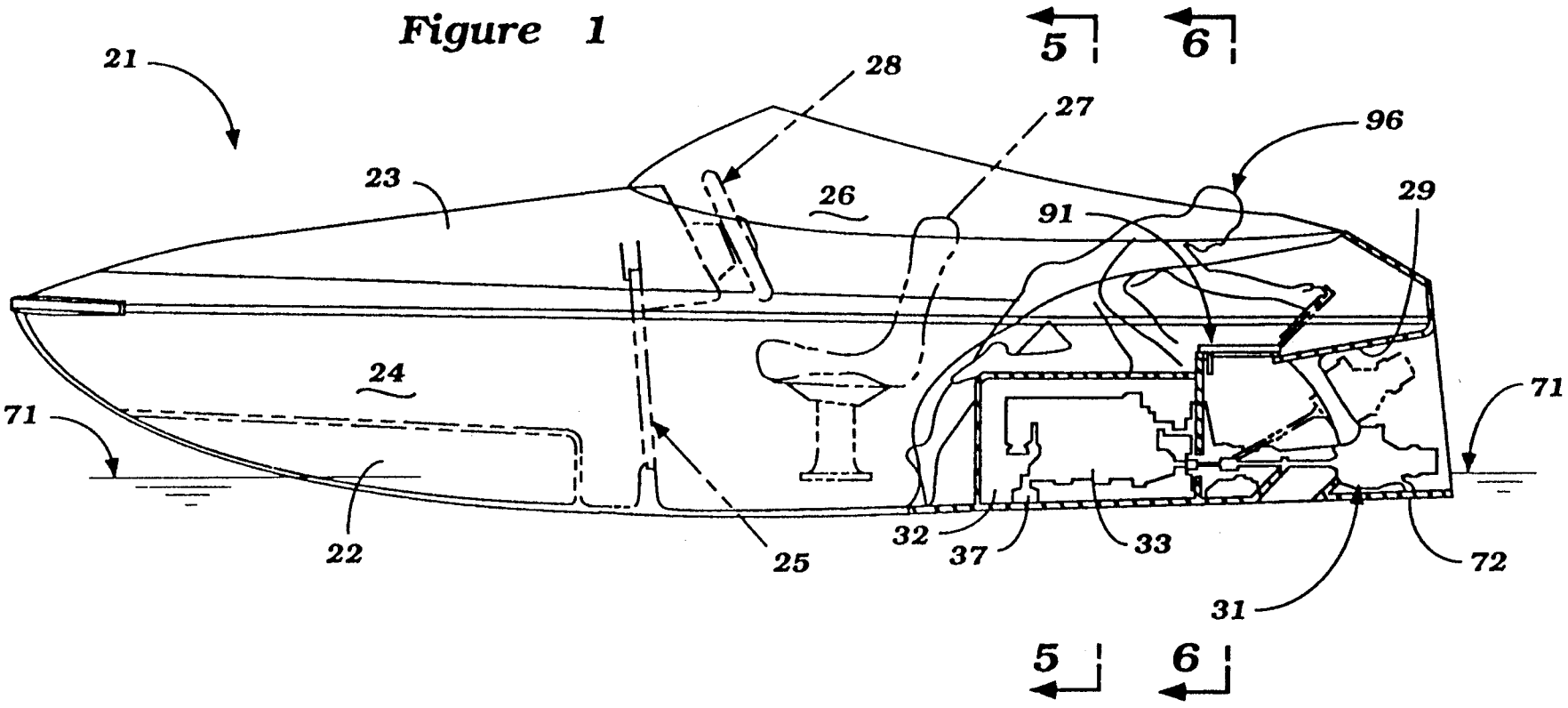
FIG. 1 is a side elevational view of a watercraft constructed in accordance with an embodiment of the invention as floating in the water with portions broken away and shown in section and other portions shown in phantom to show the servicing operation.
Figure 2:
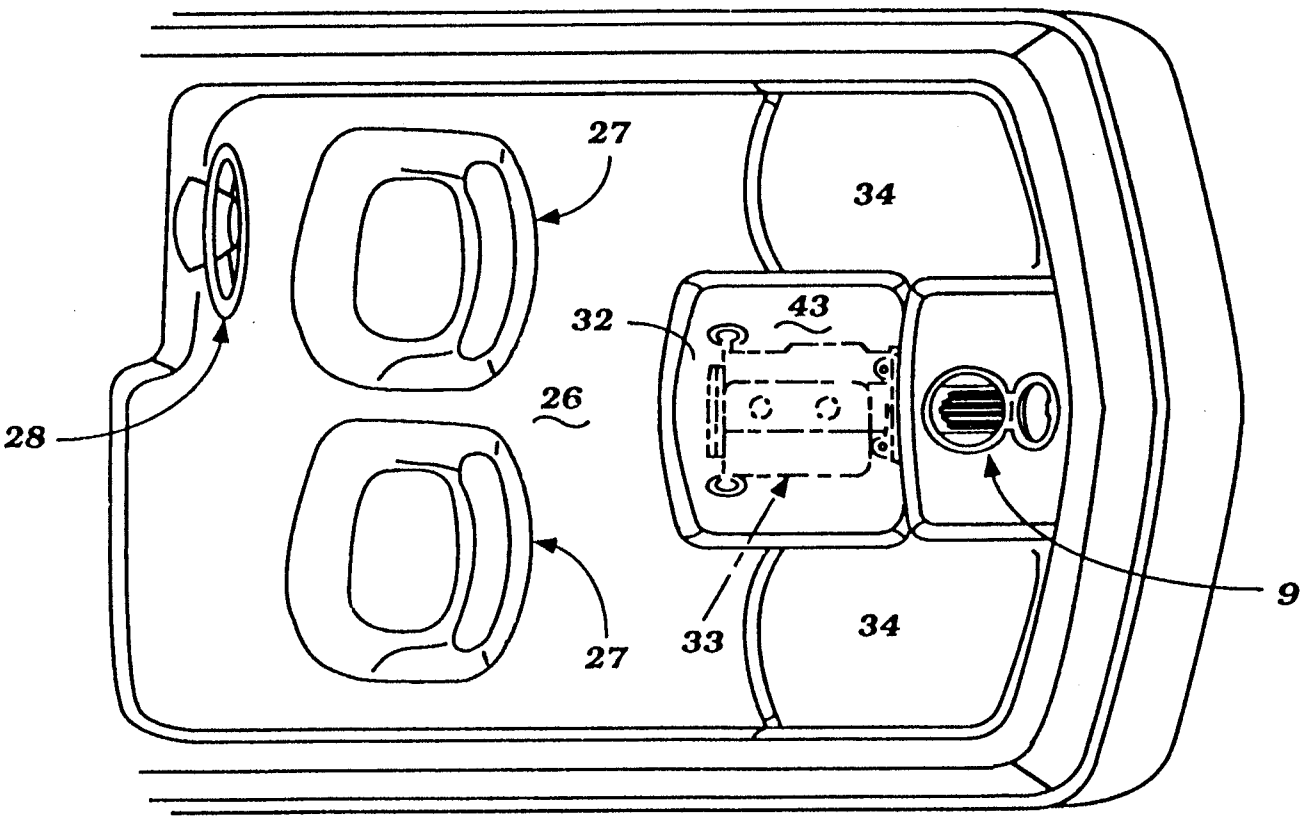
FIG. 2 is a top plan view of the watercraft showing the access compartment in an open position.

Referring first to FIGS. 1 and 2, a watercraft constructed in accordance with an embodiment of the invention and powered by a jet propulsion unit constructed in accordance with certain features of the invention is identified by the reference numeral 21. It should be understood that the hull and cabin configuration to be described is only one of many with which the invention can be practiced. The watercraft 21 is comprised of a hull assembly that includes a lower or main hull portion 22 closed by a deck 23. The hull portion 22 and deck portion 23 may be conveniently formed from molded fiberglass reinforced resins. Of course, other materials can be utilized as should be readily apparent.

The hull and deck 22 and 23 define a forwardly positioned cabin 24 that is accessible through a hatch and hatch closure 25 from an open rider's compartment 26 formed rearwardly thereof. Positioned within the open rider's area 26 are a pair of forwardly disposed seats 27, one of which is designed to accommodate the operator. A steering wheel 28 is positioned forwardly of this one seat for steering of the watercraft, in a manner which will be described.

The underside of the hull 22 is formed with a central, rearwardly disposed tunnel portion 29 in which a jet propulsion unit, indicated generally by the reference numeral 31 is positioned in a manner to be described. An engine compartment 32 is positioned forwardly thereof and contains an internal combustion engine 33 for driving the jet propulsion unit 31 in a manner to be described. A pair of rear decks or seats 34 are provide on opposite sides of the tunnel 29 an engine compartment. 32.

Figure 3:
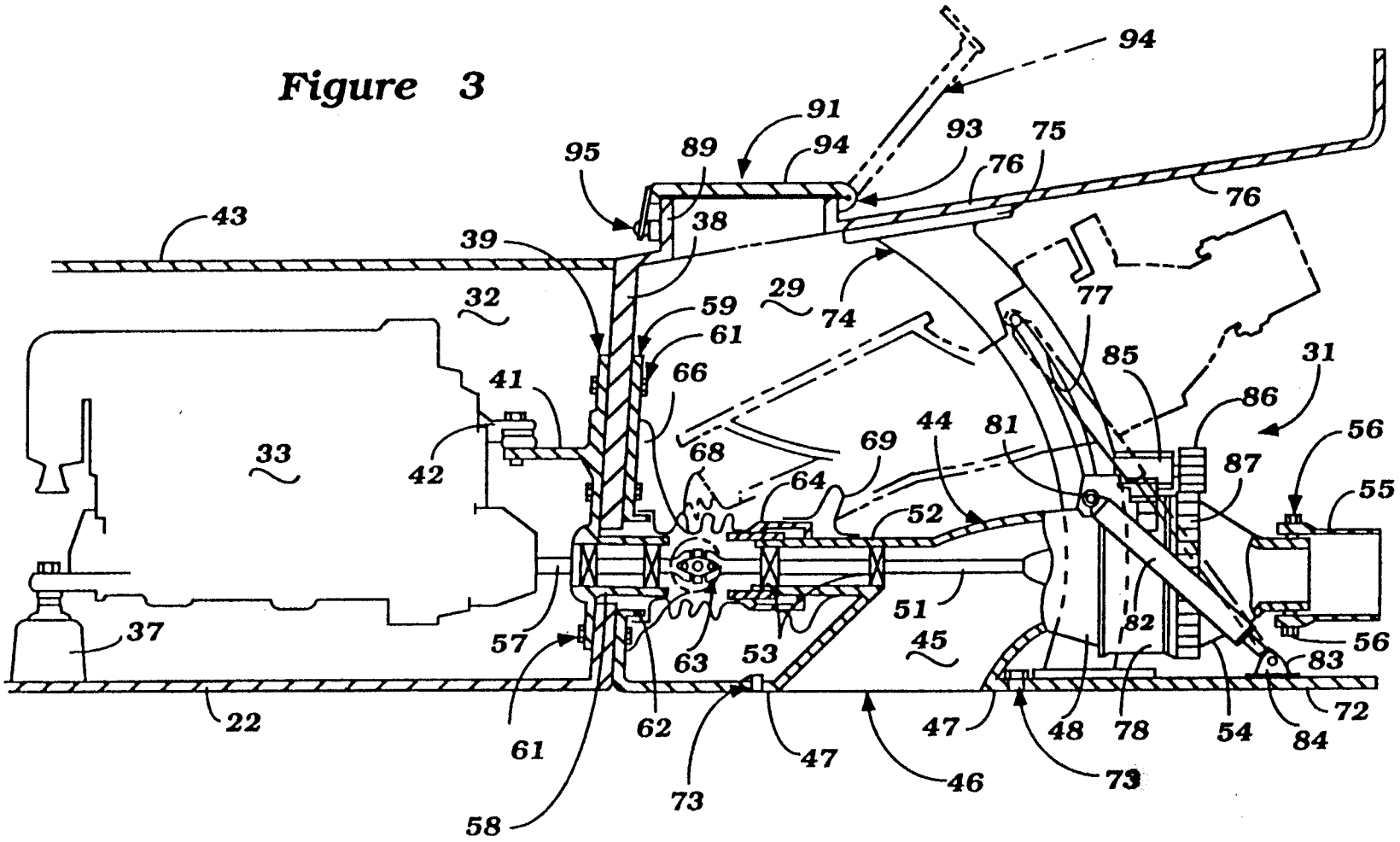
FIG. 3 is a cross sectional view taken through the hull of the watercraft and shows the jet propulsion unit and its driving arrangement.
Figure 5:
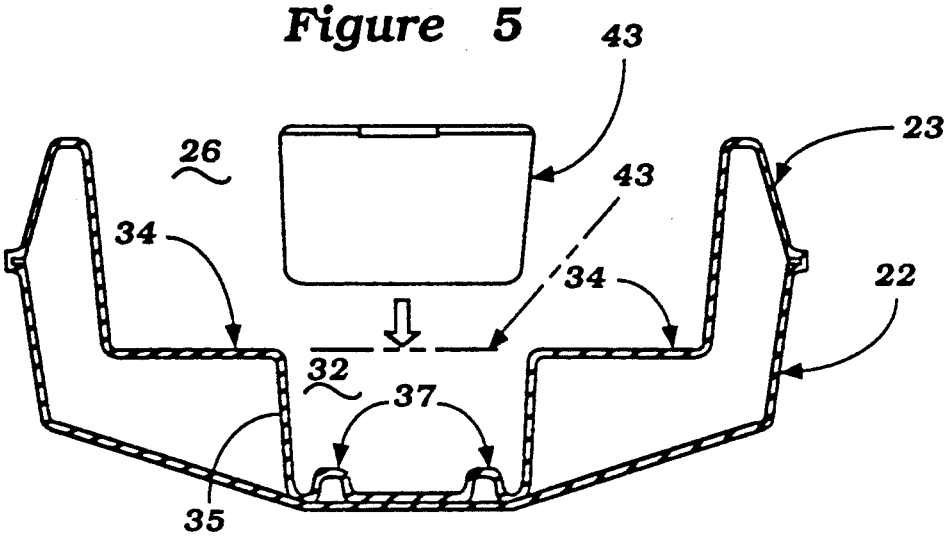
FIG. 5 is a cross sectional view taken along the line 5—5 of FIG. 1.
Figure 6:
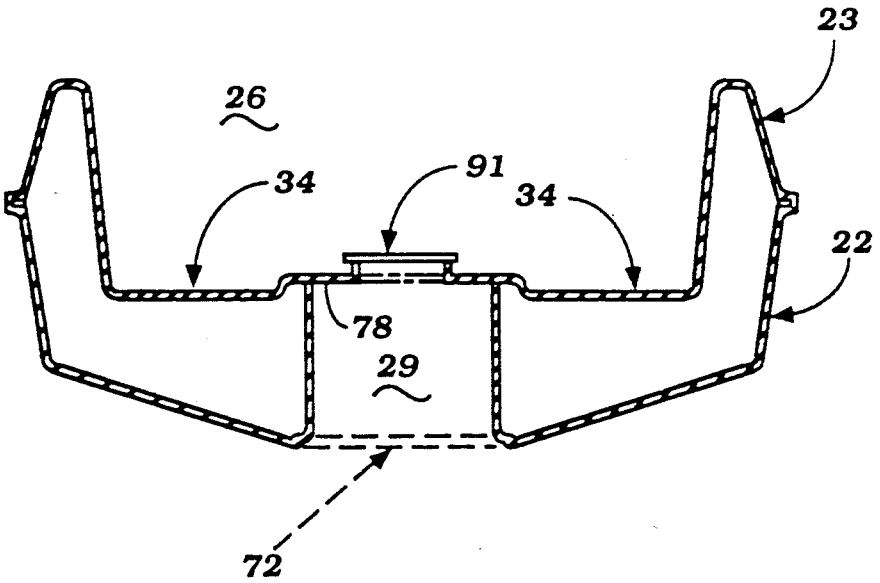
FIG. 6 is a cross sectional view taken along the line 6—6 of FIG. 1.

Referring now primarily to FIGS. 1, 3 and 5, the engine compartment 32 is formed in part by a pair of vertically extending side walls 35 that depend from a decks or seals 34 of the rider's compartment 26. A pair of forwardly disposed embossments 37 are formed therein so as to provide a means of attachment of the forward portion of the engine 33 thereto. The rear end of the engine compartment 33 is defined by a vertically extending bulkhead 38 that separates the engine compartment 32 from the tunnel 29. A bearing plate 39 is affixed thereto that has a forwardly extending portion 41 to which rear engine mounts 42 are affixed for completing the mounting of the engine 33 within the engine compartment 32 The engine compartment is further completed and enclosed by means of a removable engine cover 43 as best shown in FIG. 5, which can be conveniently put in place and removed so as to afford access to the engine 33.

Figure 4:
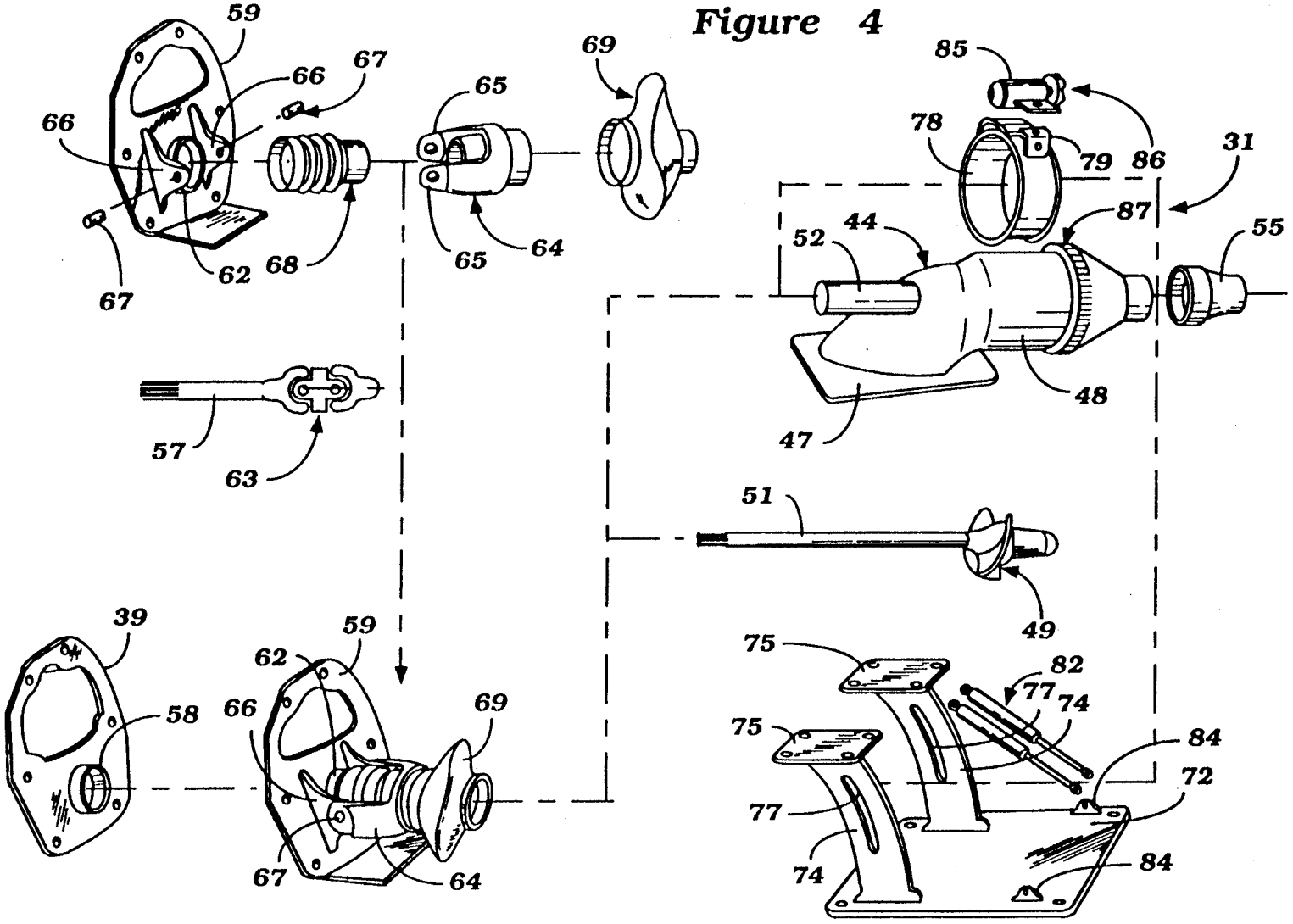
FIG. 4 is an exploded perspective view of the jet propulsion unit and its mounting arrangement.

Referring now in detail primarily to FIGS. 3 and 4, it will be noted that the jet propulsion unit 31 is comprised primarily of an outer housing 41 which may be of a unitary or fabricated construction. The outer housing 44 defines a water inlet portion 45 that terminates in a downwardly extending water inlet opening 46 that is defined by a peripheral flange 47. In the normal operating condition, the opening 46 and a portion of the inlet 44 is disposed beneath the normal operating water level.

Rearwardly of the inlet portion 45, the housing 44 defines an impeller housing portion 48 in which an impeller 49 (FIG. 4) is supported for rotation in a suitable manner. The impeller 49 is affixed to an impeller shaft 5I which, in turn, extends forwardly through the water inlet portion 45 and through a cylindrical projection 52 of the housing 44. A pair of water seals 53 are interposed between the impeller shaft 51 and the housing portion 52 so as to prevent leakage.

The impeller housing 48 terminates at its rearward end in a convergent section 54 to which a pivotally supported steering discharge nozzle 55 is journaled about a pair of vertically extending pivot pins 56. The steering nozzle 55 is steered from the steering wheel 28 in a mechanism which will be described in more detail by reference to one of the other embodiments.

The engine 13 drives an output shaft 57 that extends through a cylindrical flange portion 58 of the plate 39. A further support plate 59 is affixed to the rear side of the bulkhead 38 by threaded fasteners 61 which also serve to affix the plate 39 to the bulkhead 38 This plate also has a cylindrical flange 62 that is telescoped around the flange 58.

At its rear end, the engine driven shaft 58 is connected by means of a universal joint, indicated generally by the reference numeral 63 to the impeller shaft 51. A yoke member 64 has a connection to the forward end of the impeller housing portion 52 and has a pair of bifurcated arms 65 that are pivoted to a pair of rearwardly extending arms 66 of the plate 59 by means of pivot pins 67. As a result of this connection, the entire jet propulsion unit 31 may be pivoted about a transverse horizontally extending axis defined by the pivot pin 67 relative to the hull of the watercraft, for a reason which will be described. An elastic sealing boot 68 encircles the universal joint 63 and provides a watertight seal in this area.

A further flexible sealing boot 69 is provided around the jet propulsion unit portion 52 and the yoke 64 so as to provide good watertight construction while permitting relative rotation of the jet propulsion unit 31 about the axis of the impeller shaft 51 in a manner as will be described. The boots 68 and 69, therefore, act together so as to provide a good watertight seal and so as to permit the movements which will be described.

As should be readily apparent, the jet propulsion unit 31 provides a good power source for the watercraft and nevertheless provides a very neat and clean appearance. When the watercraft 21 is in its normal operating mode, the water inlet portion 45 and inlet opening 46 of the jet propulsion unit 31 will be submerged at least partially below the normal water level in which the watercraft is operating, which water level is shown in the drawings by the line 71. However, as a result of this submersion, foreign material and encrustation can occur on the jet propulsion unit such as barnacle formation. This is not at all desireable. Therefore, an arrangement is provided for pivoting the jet propulsion unit 31 upwardly about the pivot axis described by the pivot pins 67 during periods of time when the watercraft is not in use. This mechanism includes a plate 72 that is affixed to the rear of the hull 22 beneath the tunnel 29 and rearwardly of the water inlet opening 46 of the jet propulsion unit 31.

It should be noted that a seal arrangement 73 is carried by the peripheral flange 47 of the jet propulsion unit housing around the inlet opening 46 for sealing with the hull, the plate 72 and a horizontally extending flange the plate 59 when the unit is in its normal drive position, as shown in the solid line view of FIG. 3. This is important for insuring good efficiency of the jet propulsion unit 31.

The plate 72 has a pair of upwardly extending arcuate arms 74 that have flanges 75 at their upper end which are secured to the underside of a surface 76 of the hull which defines the tunnel 29. The arms 74 have arcuately shaped slots 77 which extend along a radius defined by the pivot points defined by the pins 67 that pivotally journal the jet propulsion unit 31. A support ring 78 encircles the jet propulsion unit and specifically the impeller housing portion 48 and journals it for rotation about an axis that is coincident with the rotational axis of the impeller shaft 51. The support ring 78 has a bracket portion 79 affixed to its upper end and which receives a pair of pins 81 for slidably supporting the support ring 78 in the slots 77 of the arms 74. In addition, a pair of hydraulic cylinders 82 are pivotally connected at one end to the pins 81 and at their opposite ends, by means of further pins 83 to a pair of lugs 84 formed on the plate 72.

When the cylinders 82 are extended or retracted, the jet propulsion unit 31 will be pivoted about the first axis defined by the pins 67 which are aligned with the universal joint 63 between its lower normal position as shown in the solid line figure of FIG. 3 to a raised or out of the water storage, service position as shown in the phantom line views of this figure. When so raised, the unit opening 46 will be disposed above the water level 71 and hence the jet propulsion unit 31 will be raised out of the water and the problems as aforenoted will not occur. In addition, all water will drain out of the jet propulsion unit 31 and this will provide assurance against any problems.

In order to provide further assurance against water damage when the watercraft is not being operated and also so as to afford access for servicing, the jet propulsion unit 31 may be rotated about the aforedescribed pivotal axis defined by the support ring 78. To this end, an electric or hydraulic motor 85 is supported on the support ring 78 and has a driven gear 86 that is enmeshed with a ring gear 87 formed on the jet propulsion unit 31. When the motor 85 is operated, the entire jet propulsion unit 31 will rotate about the axis of the impeller shaft 51 while the boot 69 torsionally deflects so that the unit 31 may be positioned so that the water inlet portion 45 and inlet opening 46 instead of facing downwardly face upwardly. This will place the inlet opening 45 in such a direction that water cannot inadvertently enter the jet propulsion unit when it has been elevated.

Figure 8:
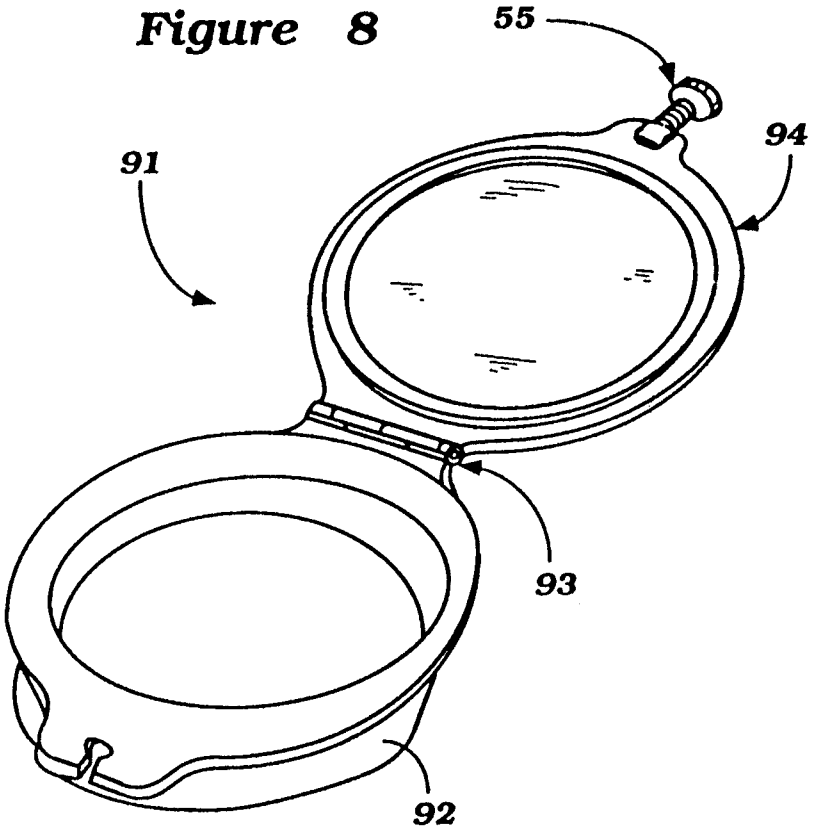
FIG. 8 is an enlarged perspective view of the servicing access shown in its open position.
Figure 7:
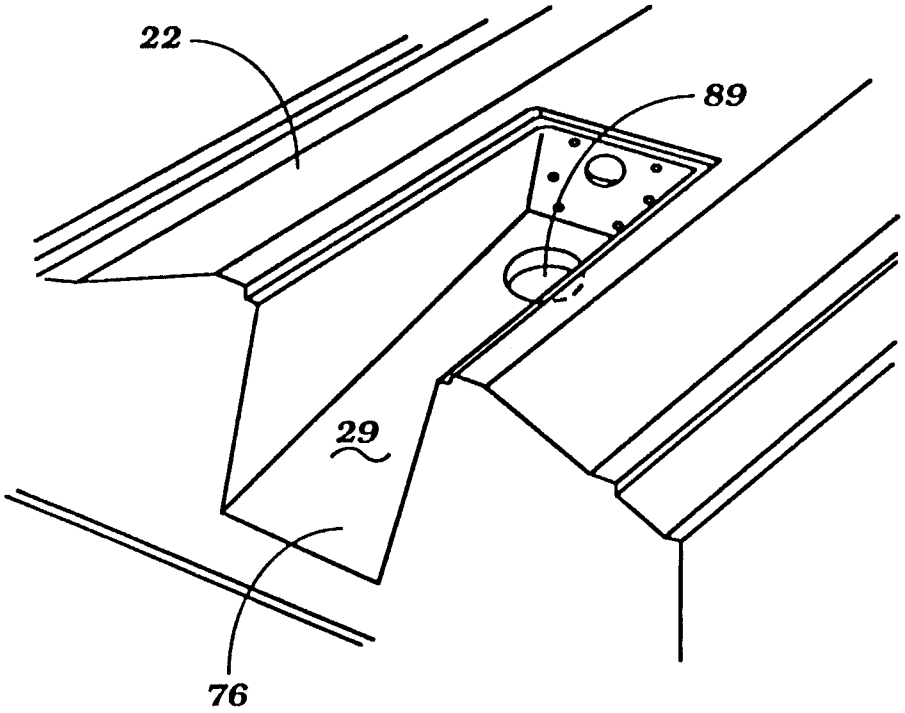
FIG. 7 is a bottom perspective view of the rear portion of the hull with the jet propulsion unit removed.
Figure 9:
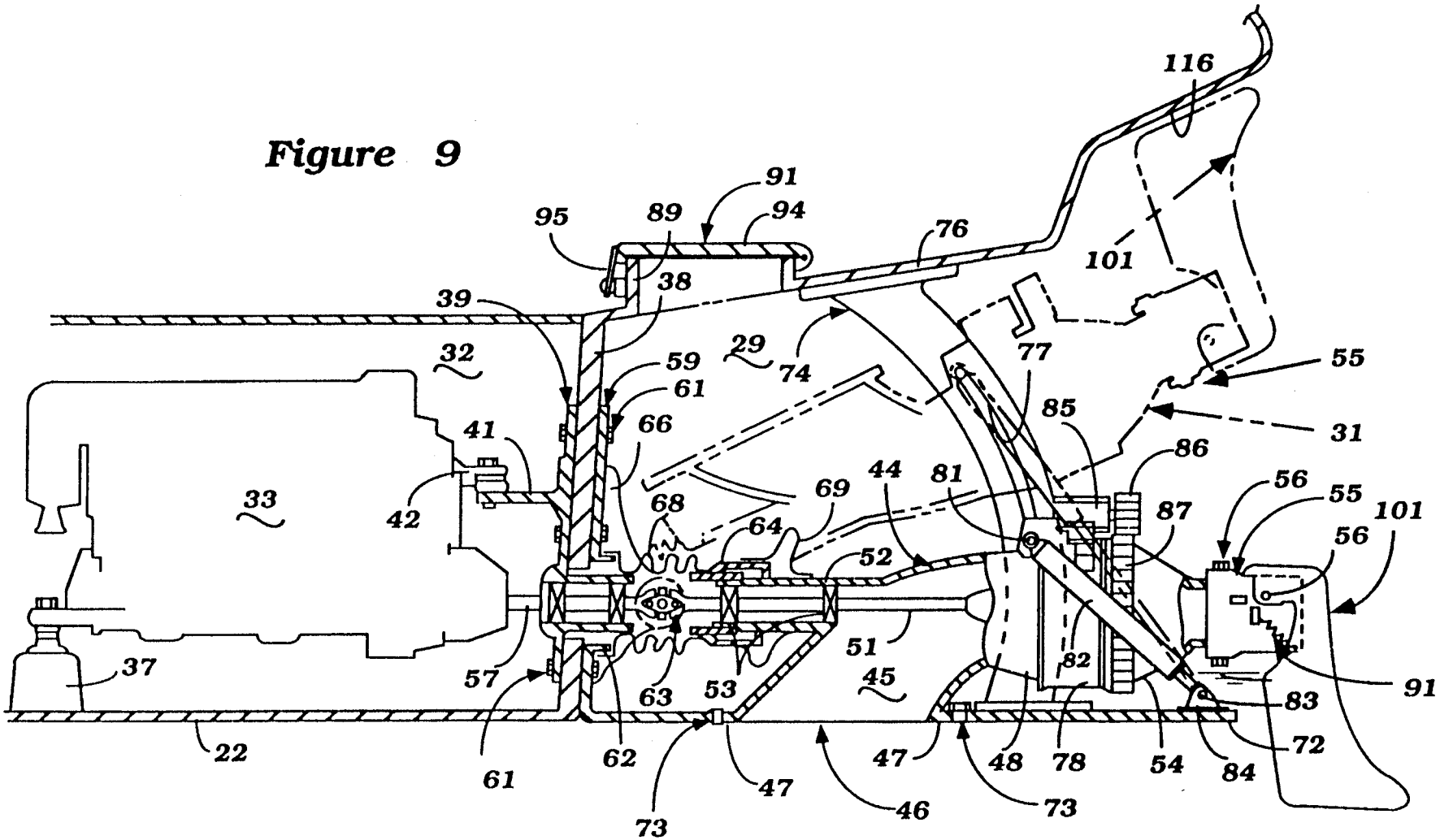
FIG. 9 is a cross sectional view, in part similar to FIG. 3, and shows another embodiment of the invention.
Figure 11:
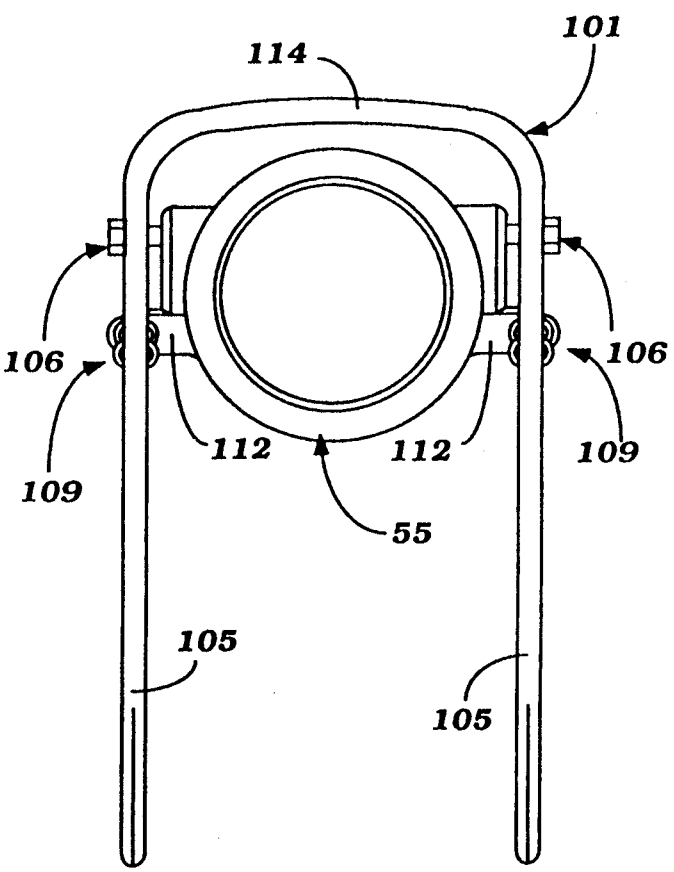
FIG. 11 is a rear elevational view of this embodiment.

This rotation also gives rise to the ability to service the unit by removing foreign particles from the impeller housing through the opening 46. To accomplish this, there is provided an access opening 89 in the hull portion 76 that has an access door 91 for its servicing. The access door 91 has a construction as best shown in FIG. 8 and the associated opening 89 is shown for pivotally supporting a closure plate 94 for movement between a closed position as shown in FIG. 3 and an open or service position as shown in phantom in FIG. 3 and also in solid lines in FIG. 8. A turnbuckle type fastener 95 cooperates with the flange 92 for holding the closure plate 94 in its closed position.

As may be readily seen in FIG. 1, an operator 96 may conveniently open the access door 91 and obtain access to the jet propulsion unit 31 when it has been pivoted about the pivot axis defined by the pivot pins 67 through actuation of the cylinder assemblies 82 by a suitable control and when the motor 85 has been rotated so as to swing the jet propulsion unit 31 to its service position as shown in phantom in FIG. 3. The operator may easily reach into the inlet opening 46 and clear any entrapped material from the impeller housing. In addition to permitting the jet propulsion unit 31 to be swung up for servicing as aforedescribed and for protection when not in use, the hydraulic motors 82 may be operated so as to provide trim adjustment for the unit 31.

The arms 45 in addition to providing a path of movement for the jet propulsion unit 31 as it pivots about the axis defined by the pivot pins 67, also serve to take side thrusts from the jet propulsion unit during its operation Thus, the assembly is quite rigid even though the jet propulsion unit 31 may pivot both about a horizontally extending transverse axis and a longitudinally extending horizontal axis. It should be noted that it is desirable to effect pivotal movement about the transverse pivot axis before rotation of the jet propulsion unit 31 about the longitudinal axis is accomplished in order to minimize wear on the seal 73. In the illustrated embodiment, the seal 73 is being described as being carried by the flange 47 of the jet propulsion unit 31. It is to be understood, of course, that the seal can be fixed to the hull of the watercraft rather than the jet propulsion unit. In addition, various other types of seal arrangements can be employed without deviating from the invention.

In the embodiment as thus far described, the entire steering effect for the watercraft 21 was accomplished through pivotal movement of the steering nozzle 55 of the jet propulsion unit 31. As has been previously noted, there are times when additional steering effect may be desirable, such as when travelling at low speeds or when coasting. FIGS. 9 through 12 show another embodiment of the invention which has all of the attributes of the embodiment as thus far described and further includes a steering assist rudder mechanism, indicated generally by the reference numeral 101.

Except for this variation, this embodiment is the same as the previously described embodiment. For that reason, components which are the same have been identified by the same reference numerals and will not be described again, except insofar as is necessary to understand the construction and operation of this embodiment. Because of the similarities, further discussion of the jet propulsion unit, its mounting in the hull and its rotary motion and pivotal movement will not be repeated.

Figure 10:
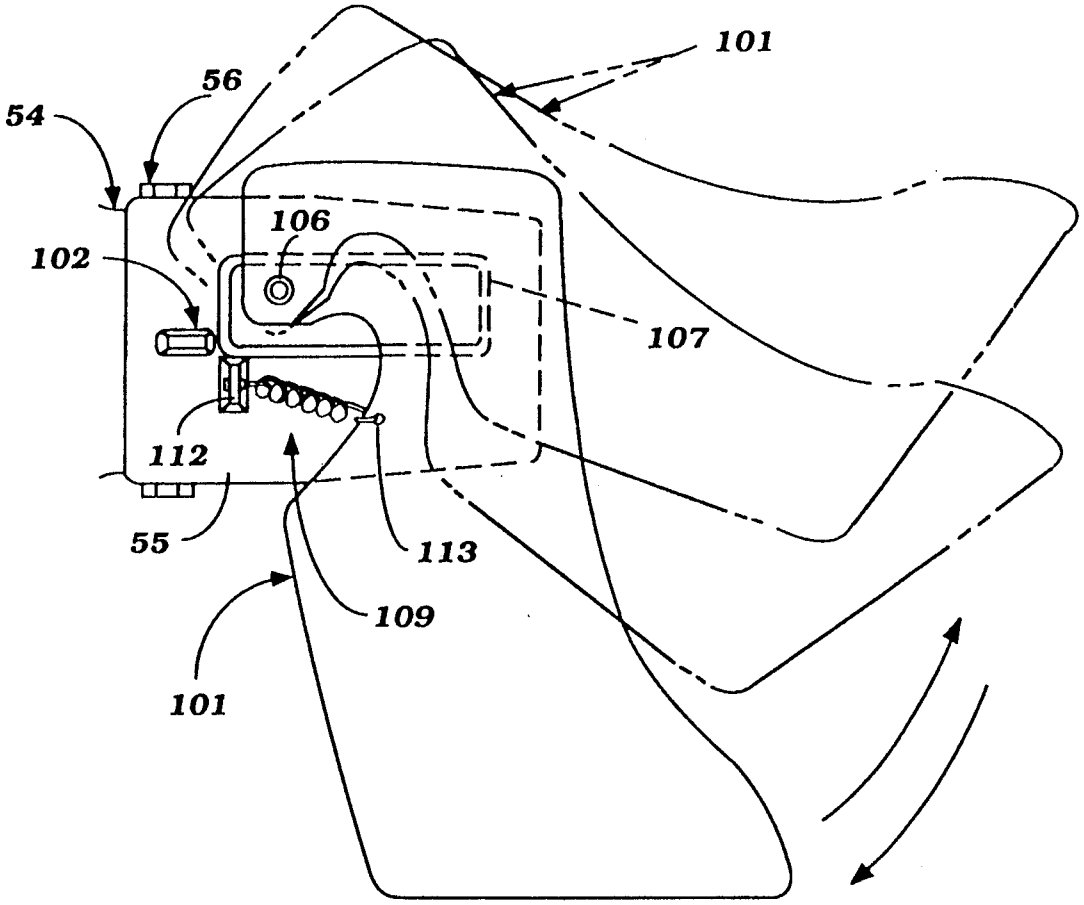
FIG. 10 is an enlarged side elevational view of the discharge nozzle and steering rudder of this embodiment showing the pivotal movement of the steering rudder when an underwater obstacle is struck.
Figure 12:
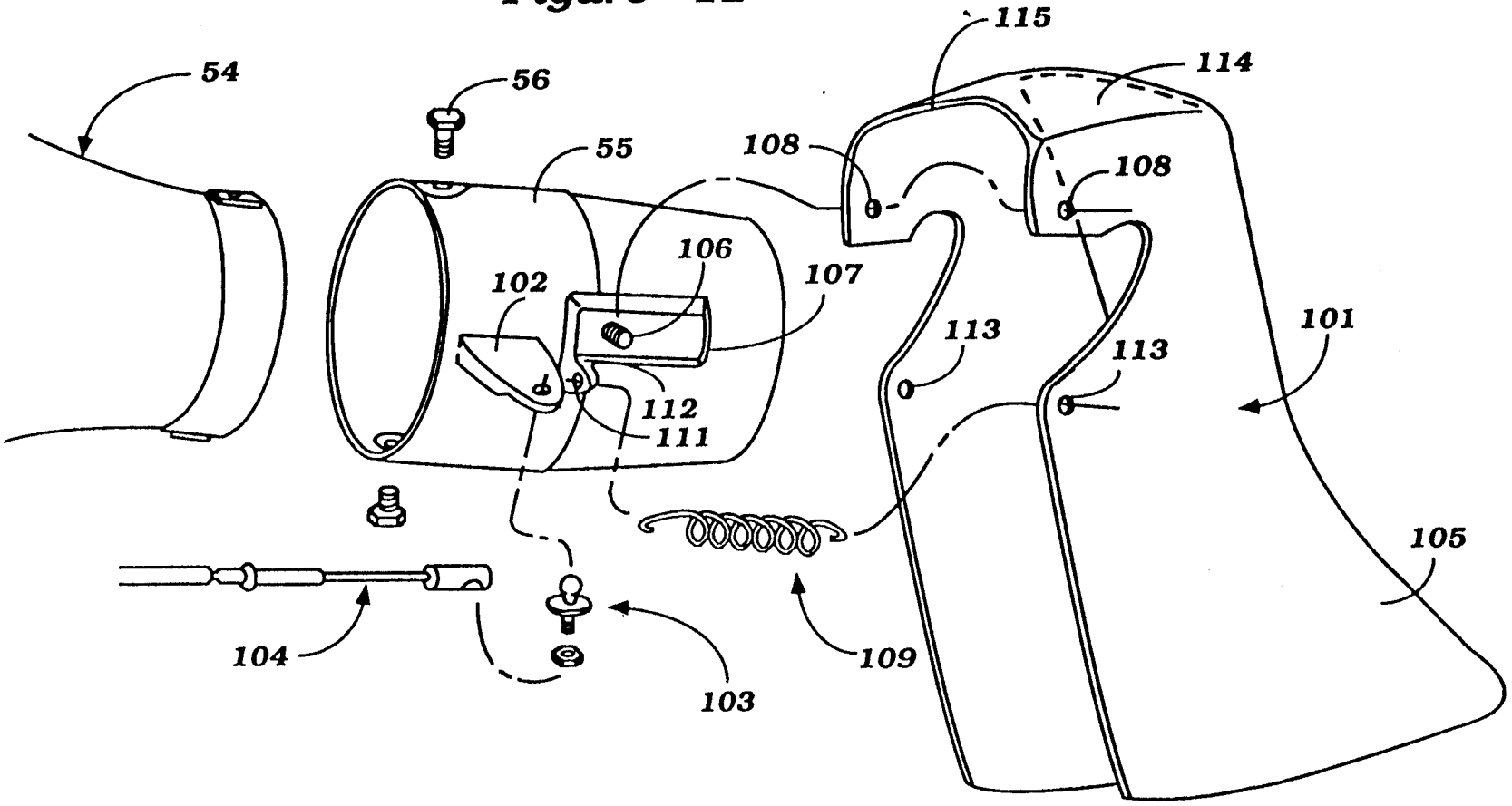
FIG. 12 is an exploded perspective view of this embodiment.

FIGS. 10 and 12 show the steering mechanism for the steering nozzle 55 This steering mechanism includes a steering arm 102 that is integrally formed with the steering nozzle portion 55 and which has an eyelet that receives a spherical joint 103 connected to one end of a bowden wire cable 104. The other end of the bowden wire cable 104 is connected to the steering wheel in an appropriate manner.

Referring now to the rudder mechanism 101, it will be seen that it has a generally inverted U shape with a pair of steering rudder arms 105 which lie on opposite sides of the steering nozzle 88 and which have a pivotal connection thereto by means of pivot pins 106 that extend outwardly from brackets 107 affixed to opposite sides of the steering nozzle 55 and which are received within openings 108 formed in the arms 105. A pair of tension springs 109 are affixed in openings 111 formed in outwardly extending lugs 112 of the brackets 107. The opposite ends of the springs 109 are received in openings 113 formed in the rudder arms 105. The springs 109 have sufficient tensile force or preload so as to retain the rudder arms 105 in their normal submerged position where they extend beneath the plate 72 as clearly shown in FIG. 9.

In the event an underwater obstacle is struck, the rudder arms 105 may pivot as shown in the phantom line views in FIG. 10 about the pivot pins 106 so as to clear the underwater obstacle Immediately upon clearing of the underwater obstacle, the springs 109 will return the rudder arms 105 to their steering position. It should be noted that the rudder arms 105 are interconnected by a bridge portion 114 that overlies the steering nozzle 55 but which has a recess 115 therein which is sufficiently large so as to permit full tilt up of the rudder assembly 101 so as to avoid damage.

It should also be noted that in this embodiment, the tunnel 29 is provided with a raised portion 116 at its rear end so as to clear the rudder assembly 101 when the jet propulsion unit 31 is elevated and rotated to its out of the water service or storage position.

Figure 14:
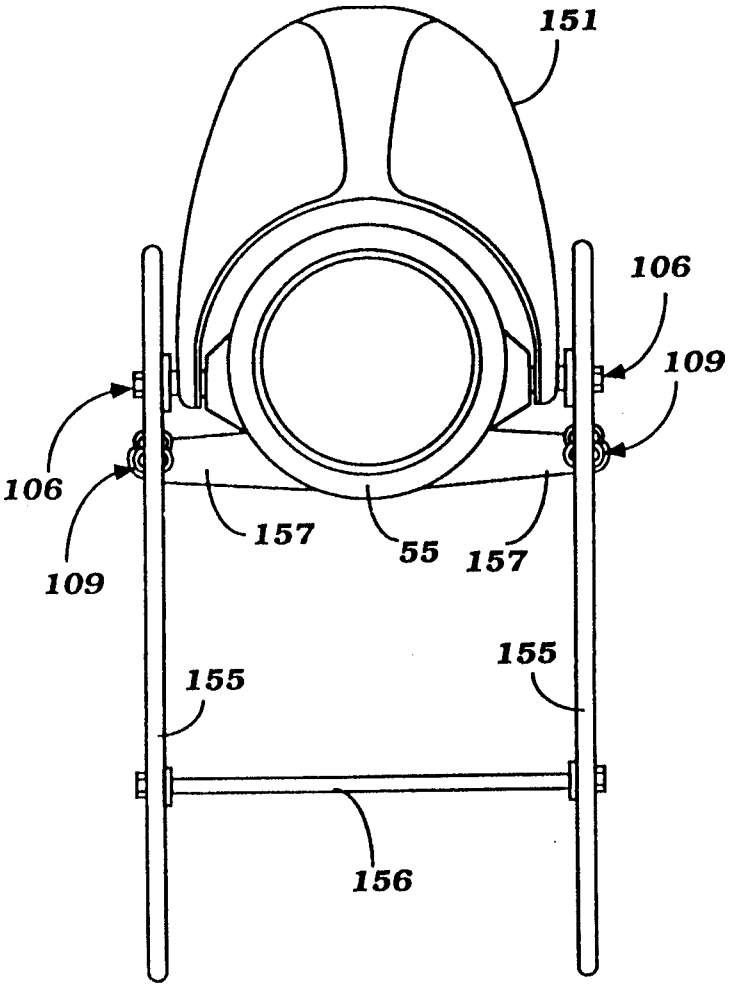
FIG. 14 is a rear elevational view of this embodiment.
Figure 13:
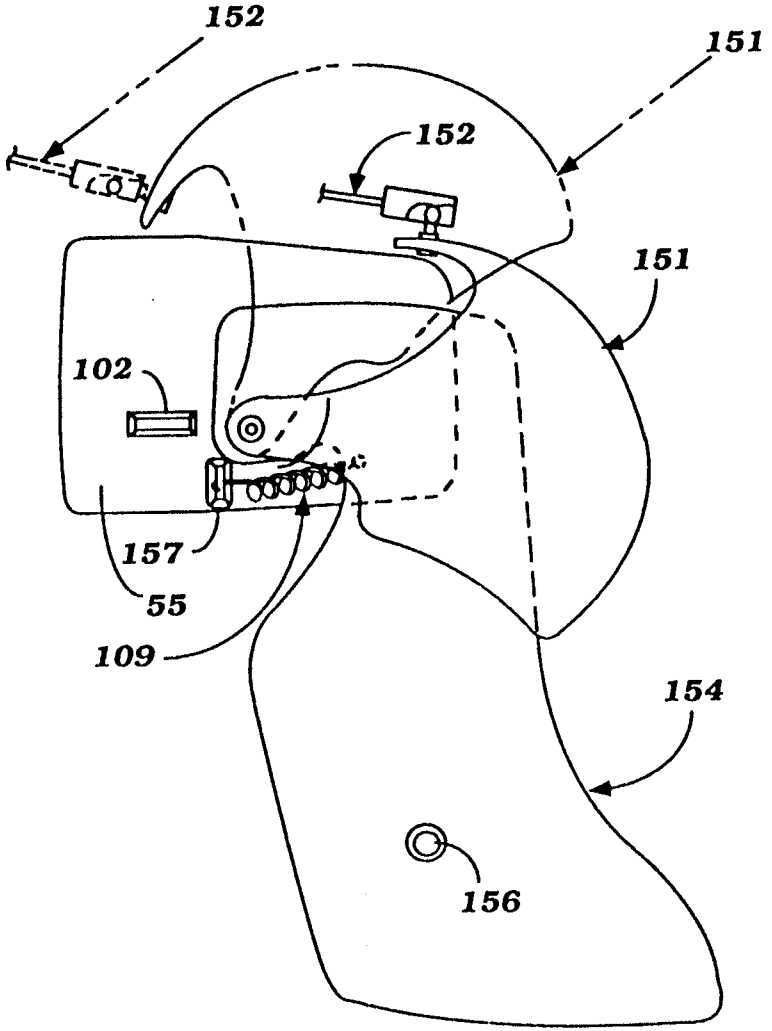
FIG. 13 is a side elevational view, in part similar to FIG. 10, showing another embodiment of the invention.
Figure 15:
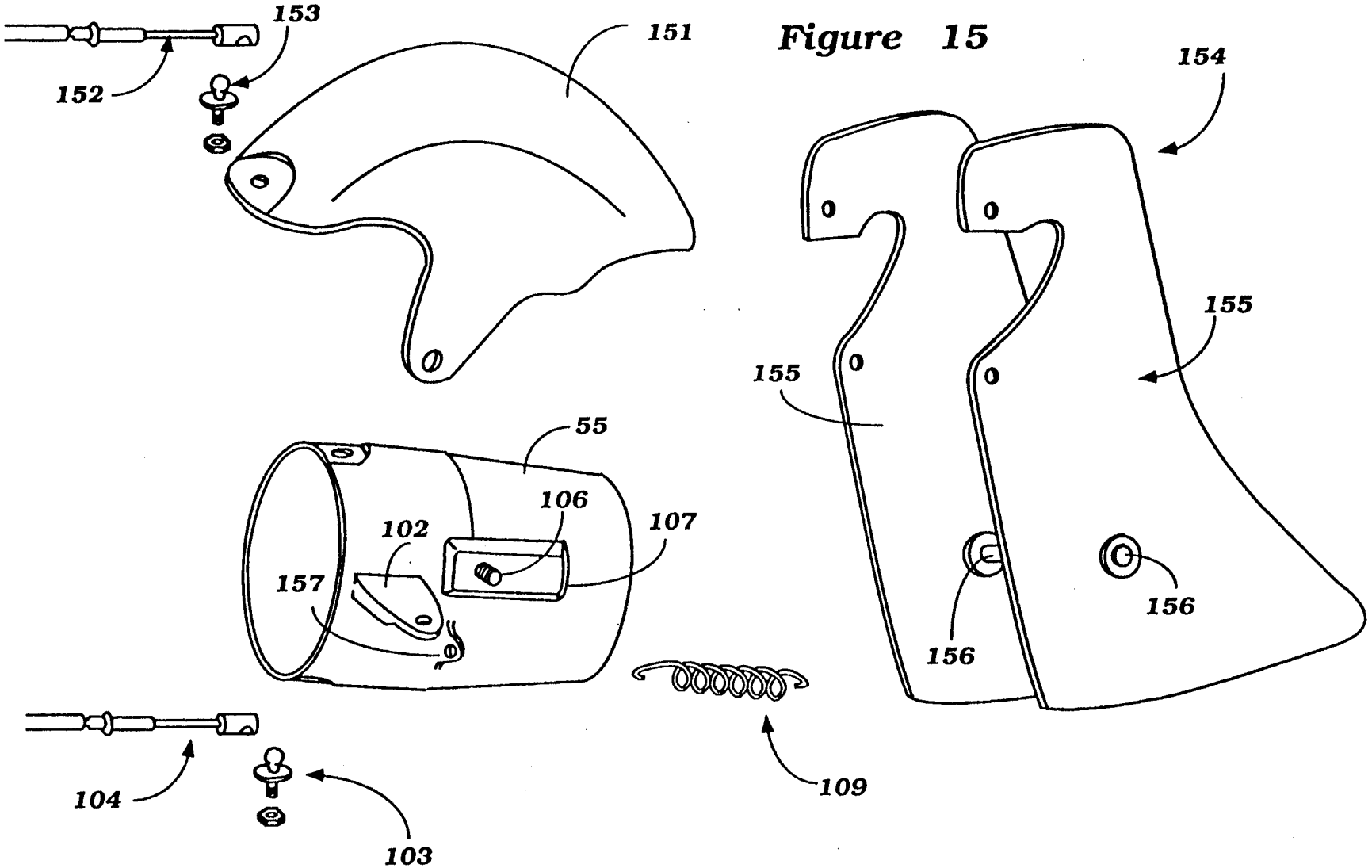
FIG. 15 is an enlarged exploded perspective view of this embodiment.

FIGS. 13 through 15 show another embodiment of the invention which is generally the same as the embodiment of FIGS. 9 through 12 but in which a reverse thrust bucket assembly 151 is also associated with the steering nozzle 55 for generating reverse thrust and for permitting the watercraft to be operated in a reverse direction. In this embodiment, the reverse bucket assembly 151, which may take any known configuration is pivotally supported on the pins 106 and is connected to a bowden wire actuator 152 which extends to the rider's compartment 26 to an appropriate control (not shown) for steering of the watercraft. A spherical joint 153 is connected to the forward end of the bucket 151 for this operation.

Because of the incorporation of the reverse thrust bucket 151, a multipart rudder assembly, indicated generally by the reference numeral 154 is provided that is supported outwardly of the bucket assembly 151 on the pivot pins 106. The rudder assembly 154 includes a pair of spaced apart rudders 155 which are, in turn, interconnected by means of a cross piece 156. In this embodiment, the torsional spring 109 is connected to the rudders 155 and to lugs 157 which, unlike the previous embodiment, are formed directly on the bucket assembly 55. Of course, a construction of the type as shown in the previously described embodiment may also be employed in lieu of forming the lug 157 directly on the steering nozzle 55.

It should be readily apparent that the reverse bucket assembly 151 may be moved between its positions without interference from the rudder assembly 154 and also that the rudder assembly may operate as in the previously described embodiment. That is, the rudder assembly 154 will normally be maintained in the position shown in the figures and can pivot upwardly when an underwater object is struck by the yielding of the springs 109. The springs 109 will return the rudder assembly 154 to its normal position once the underwater object has been cleared.

Figure 17:
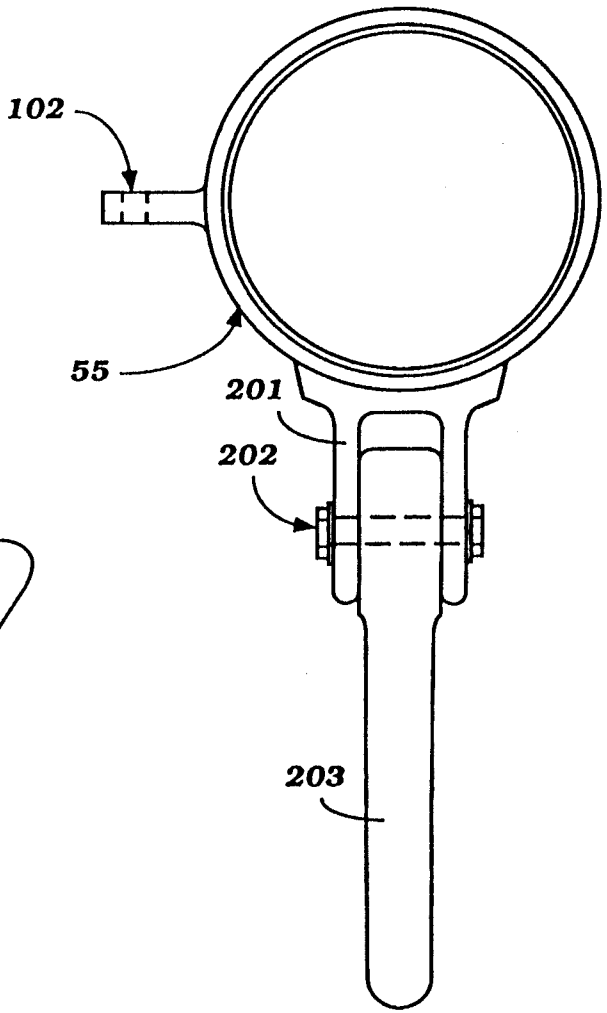
FIG. 17 is a rear elevational view of this embodiment.
Figure 16:
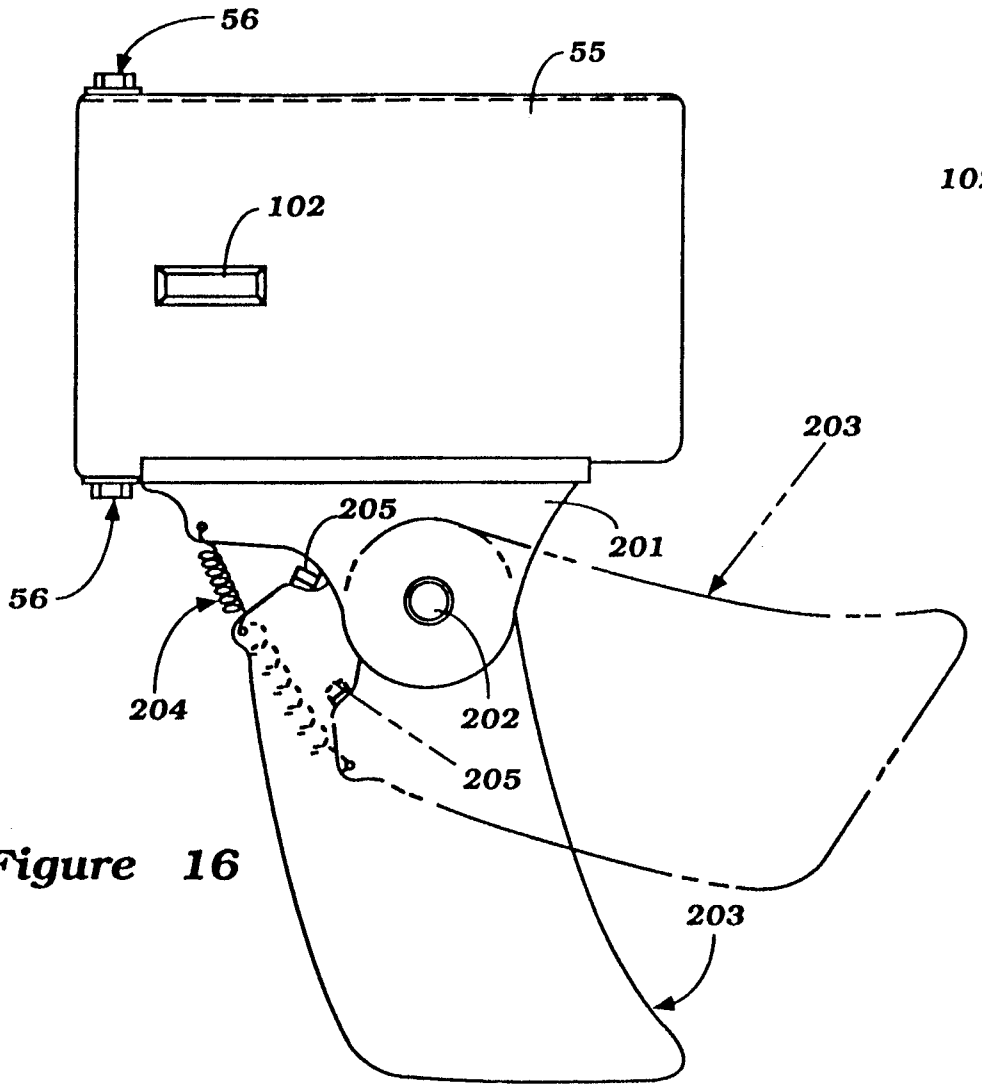
FIG. 16 is a side elevational view, in part similar to FIGS. 10 and 13, and shows yet another embodiment of the invention.

Yet another embodiment of rudder assembly is shown in FIGS. 16 and 17. Since this embodiment is quite similar to those previously described, those components which are the same or substantially the same as previously described embodiments have been identified by the same reference numerals as applied in those embodiments.

In this embodiment, a bracket assembly 201 is affixed to the underside of the steering nozzle 55 and has a pair of bifurcated arms that receive a pin 202. A single rudder 203 is journaled by the pin 202 between these arms for movement between its normal position as shown in the solid line view and its retracted position as shown in the phantom line view of FIG. 16. A torsional spring 204 acts between the rudder 203 and the bracket 201 and normally urges a stop 205 carried by the rudder 203 into engagement with a lug or a portion of the bracket 201 so that the rudder 203 will be held in its normal position during operation except when an underwater obstacle is struck.

In all of the embodiments of the invention as thus far described, the jet propulsion unit 31 has been pivotal about both longitudinal and transverse horizontally extending axes. Of course, certain features of the invention may be employed by merely mounting the jet propulsion unit 31 for rotation about the longitudinally extending axis and FIGS. 18 through 21 show such an embodiment. Because of the similarity of this embodiment to those previously described, components which are the same or substantially the same as previously described embodiments have been identified by the same reference numerals and will be described again only insofar as is necessary to understand the construction and operation of this embodiment.

In this embodiment, the support plate 39 does not directly support the engine 33 but rather the engine 33 is supported solely from the underside of the hull through four mounts 37. In addition, a flange 251 of the support plate 39 extends forwardly from the bulkhead 38 in addition to rearwardly. In this embodiment, since the jet propulsion unit 31 is not supported for pivotal movement, the universal joint can be eliminated as can the surrounding protective boot. The boot 69 is, therefore, directly interposed between the flange 62 of the support plate 59 and the portion 52 of the jet propulsion unit 31.

Figure 19:
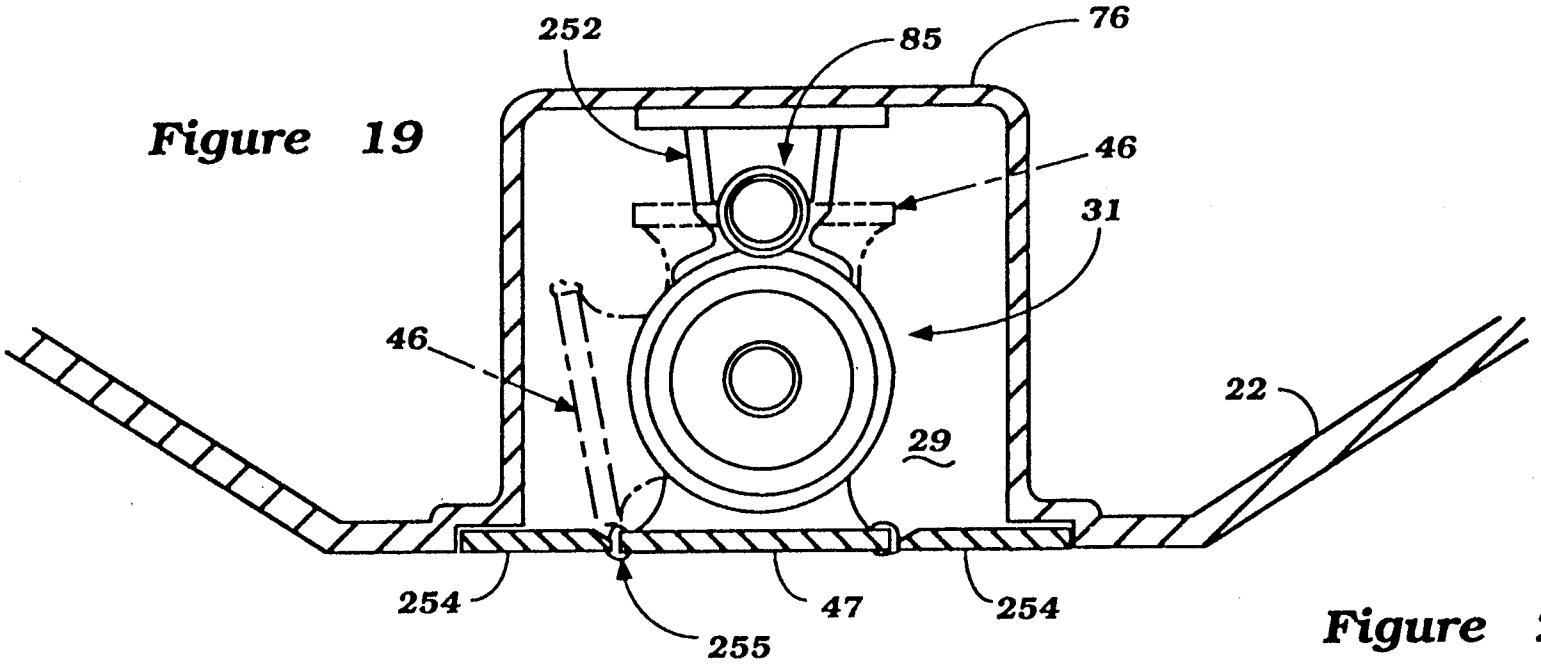
FIG. 19 is a cross sectional view taken transverse to the plane of FIG. 18.
Figure 21:
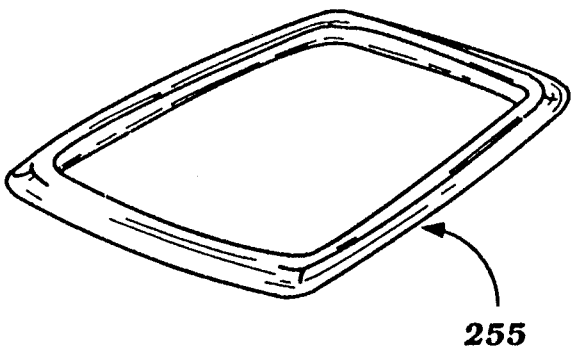
FIG. 21 is a perspective view of the seal for this embodiment.
Figure 20:
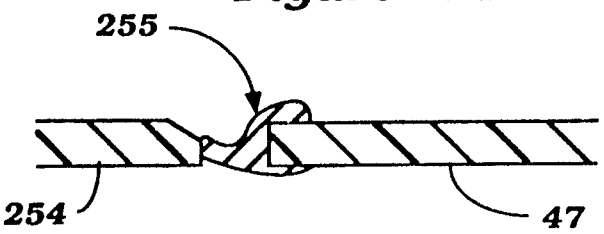
FIG. 20 is an enlarged cross sectional view showing how the jet propulsion unit seals with the adjacent portions of the hull in its normal operating condition.

The support ring 78 is, in turn, directly supported by a supporting bracket 252 that is affixed to the hull portion 76 by means of fasteners 253. In addition, a cover plate 254 is affixed to the rearward portion of the watercraft to enclose the tunnel 29 rearwardly of the jet propulsion unit inlet flange 47. A seal 255 of the lip type and shown in most detail in FIGS. 19 through 21 is affixed to the flange 47 and sealingly engages the opening formed in the plate 254 when the jet propulsion unit 31 is in its normal driving condition as shown in the solid line views of the figures. As with the previously described embodiment, the seal may be fixed to the plate 254 rather than to the flange 47.

Figure 18:
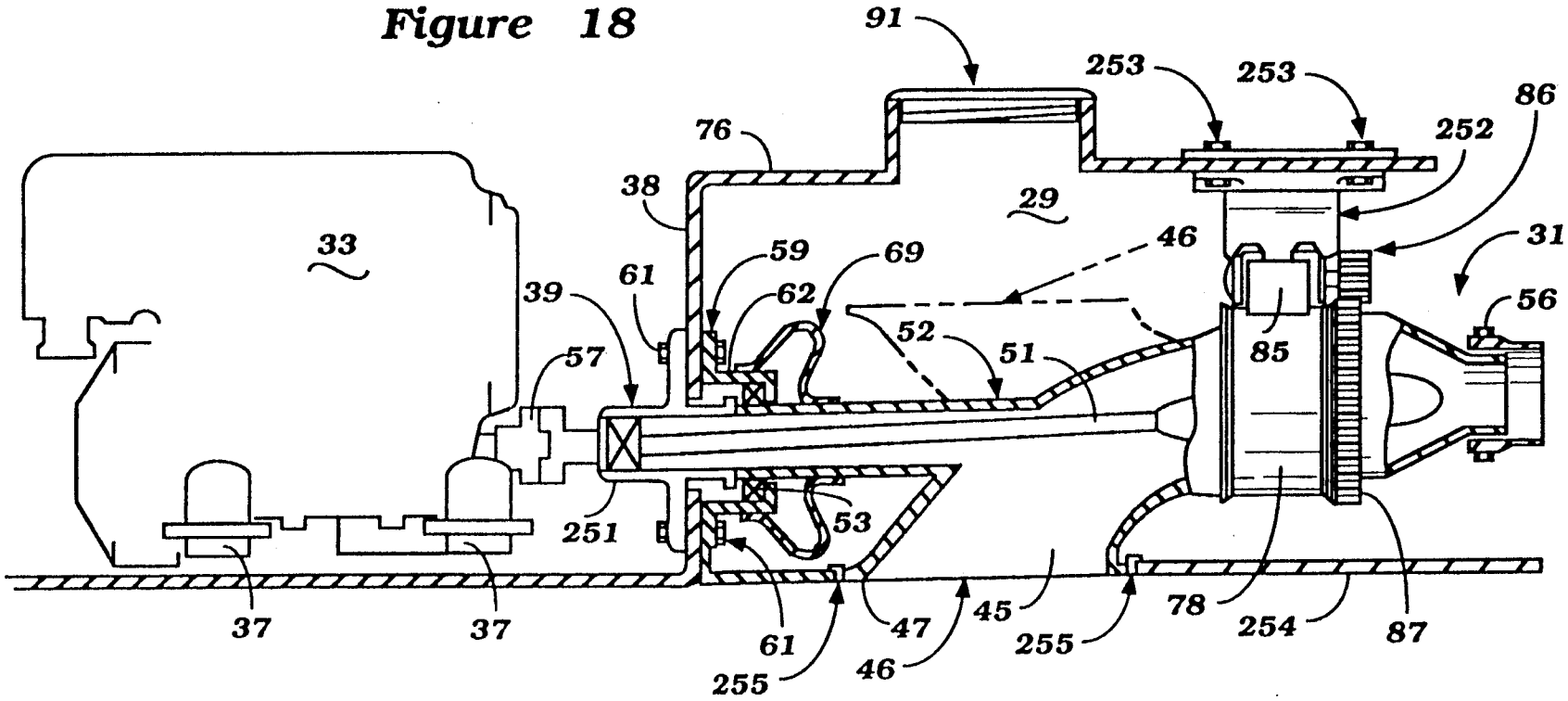
FIG. 18 is a cross sectional view, in part similar to FIGS. 3 and 9, showing another embodiment of the invention.

When the watercraft is stationary for long periods of time or for servicing purposes, the motor 85 is operated so as to rotate the jet propulsion unit 31 about the axis defined by the impeller shaft 51 to the upper or raised position as shown in FIGS. 18 and 19 through a path as shown in FIG. 19. In this way, the inlet opening 46 will be disposed above the water level and water can drain from the unit as aforedescribed. In addition, the inlet opening 46 will be accessible for servicing through the service closure 91 as previously described. Therefore, this construction has many of the advantages of the previously described embodiment but does not provide the pivotal movement about the transverse axis, as already noted.

In FIGS. 18 through 21, the engine 33 is disposed immediately adjacent the tunnel 29. It is, of course, possible to position the engine forwardly in the boat if balance in that location is preferred.

It should be readily apparent from the foregoing description that a number of embodiments of the invention have been illustrated and described, each of which provides a very good jet propulsion unit for a watercraft, which can be tilted up out of the water when not in use, even though the watercraft is still submerged, so as to avoid encrustation and other deleterious effects. In addition, the jet propulsion unit may be rotated for servicing or cleaning from within the watercraft even though the jet propulsion unit is contained within a tunnel in the hull of the watercraft. Also, a variety of rudder arrangements have been depicted which will permit steering during such times when the jet propulsion unit steering effect is not great and which will nevertheless be freely moveable to a position for protection if an underwater obstacle is struck.

Although a number of embodiments of the invention have been illustrated and described, various changes and modifications may be made without departing from the spirit and scope of the invention, as defined by the appended claims.

I claim:

1. A jet propelled watercraft comprising a hull, a jet propulsion unit having a water inlet portion defining a water inlet opening through which water may be drawn from a body of water in which said hull is operating, an impeller portion containing an impeller for pumping water and a discharge portion through which water pumped by said impeller is discharged, means for supporting said jet propulsion unit from said hull for movement of at least said water inlet portion from a downwardly facing position to an elevated position, said hull having a portion bounding at least the sides of said water inlet portion when in its downwardly facing position, and anti-leakage means for providing an area extending between the periphery of said water inlet opening of said jet propulsion unit and said hull portion at least when said water inlet portion is in its downwardly facing position for preventing the ingestion of air into said water inlet opening around said water inlet opening.

2. A jet propelled watercraft as set forth in claim 1 wherein the antileakage means comprises a flange extending around the water inlet opening at least when the jet propulsion unit is in its downwardly facing position.

3. A jet propelled watercraft as set forth in claim 2 wherein the flange is formed around the water inlet portion of the jet propulsion unit and cooperates with the hull when in the downwardly facing position.

4. A watercraft having a hull defining a tunnel at the rear end thereof which tunnel terminates at a rearwardly facing opening in a transom of said hull, a passenger compartment in said hull into which the portion of said hull defining said tunnel protrudes with passenger receiving areas on opposite sides of said tunnel and which extend rearwardly to said transom, a jet propulsion unit having a water inlet opening through which water may be drawn and a discharge nozzle from which water is discharged for the propulsion of said hull supported within said hull at least in part in said tunnel for pivotal movement about a transverse, horizontal axis between a lowered drive position positioned substantially within said tunnel and wherein said water inlet opening is substantially flush with the lower portion of said hull and said discharge nozzle registers with said transom opening and a raised storage position disposed entirely within said tunnel, said tunnel being defined at its upper extremity by an upper surface that is substantially higher above the adjacent bottom of the hull at the rear of said tunnel than at the front thereof and which upper surface overlies said jet propulsion unit in its raised storage position and an access opening formed forwardly in said hull from said upper surface.

5. A watercraft as set forth in claim 4 further including a passenger compartment formed at least in part above the tunnel and around the upper surface of the tunnel.

6. A watercraft as set forth in claim 4 further including an engine compartment formed in the hull forwardly of the tunnel and driving the jet propulsion unit through a universal joint having its pivot axis aligned with the pivot axis of the jet propulsion unit.

7. A watercraft as set forth in claim 6 wherein the engine compartment has an upper surface that is below the upper surface of at least a portion of the tunnel.

8. A watercraft as set forth in claim 7 wherein the upper surface of the engine compartment lies below the upper surface of the entire tunnel.

9. A watercraft as set forth in claim 8 further including a passenger compartment formed at least in part above the tunnel and around the upper surface of the tunnel and the engine compartment.

* * * * *